US010077511B2

(12) United States Patent
Novak et al.

(10) Patent No.: US 10,077,511 B2
(45) Date of Patent: Sep. 18, 2018

(54) MODULAR ADJUSTABLE HAND LOOM

(71) Applicants: Kim Novak, Salem, MA (US); Bill Ziegler, Reading, MA (US); David Cao, DongGuan (CN)

(72) Inventors: Kim Novak, Salem, MA (US); Bill Ziegler, Reading, MA (US); David Cao, DongGuan (CN)

(73) Assignee: Authentic Knitting Board LLC, Fork Union, VA (US)

( * ) Notice: Subject to any disclaimer, the term of this patent is extended or adjusted under 35 U.S.C. 154(b) by 570 days.

(21) Appl. No.: 14/811,533

(22) Filed: Jul. 28, 2015

(65) Prior Publication Data

US 2016/0032500 A1 Feb. 4, 2016

Related U.S. Application Data

(60) Provisional application No. 62/030,291, filed on Jul. 29, 2014.

(51) Int. Cl.
*D03D 29/00* (2006.01)
*D04B 5/00* (2006.01)
*D04B 3/00* (2006.01)

(52) U.S. Cl.
CPC ..... *D03D 29/00* (2013.01); *D04B 3/00* (2013.01); *D04B 5/00* (2013.01)

(58) Field of Classification Search
CPC ..... D03D 29/00; D03D 35/00; D03D 31/00; D03D 41/00; D04B 3/00; D04B 5/00; D04B 39/00; Y10T 403/591; Y10T 403/59; Y10T 403/60; Y10T 403/602; Y10T 403/604; Y10T 403/608; Y10T 403/7039; D04D 7/00; D04D 7/02; D04D 7/06; D04D 7/08; D04D 7/10; D04D 7/105; D04D 11/00; F16B 7/042; F16B 7/1463; F16B 7/22; F16B 7/14; F16B 12/26; B44D 3/185; D05C 1/02; D05C 1/04; D06C 3/08
USPC ..... 28/149, 151, 152; 403/321, 322.1, 326, 403/327; 38/102.3, 102.4, 102.8, 102, 38/102.5, 102.6, 102.9; 223/61; 66/1 A
See application file for complete search history.

(56) References Cited

U.S. PATENT DOCUMENTS 735,177 A * 8/1903 Truesdell ..... D03D 29/00 28/152
2,292,356 A * 8/1942 Belanger ..... D03D 29/00 28/152
2,433,307 A * 12/1947 Thomas ..... D03D 29/00 28/152
2,451,207 A * 10/1948 Ferguson ..... D03D 29/00 28/152
2,610,436 A * 9/1952 Honeycutt ..... B68G 7/08 112/2.2
2,663,066 A * 12/1953 Berger ..... D03D 29/00 28/152

(Continued)

*Primary Examiner* — Amy Vanatta
(74) *Attorney, Agent, or Firm* — Nixon & Vanderhye, P.C.

(57) ABSTRACT

A plurality of elongate loom sections are interconnected via male and female connectors to form a modular hand loom having a size that is adjustable. A first loom section has a male connector extending from an end portion of the first loom section. A second loom section has a female connector configured to connect to the male connector in a snap fit arrangement. The second loom section includes a release member to facilitate disconnection of the male connector from the female connector.

11 Claims, 14 Drawing Sheets

(56) References Cited

U.S. PATENT DOCUMENTS

| | | | | | |
|---|---|---|---|---|---|
| 3,769,667 | A * | 11/1973 | Cooper | D03D 29/00 | 28/152 |
| 3,800,372 | A * | 4/1974 | Daoust | D03D 29/00 | 28/152 |
| 3,996,969 | A * | 12/1976 | McCullough | D03D 29/00 | 139/29 |
| 4,023,245 | A * | 5/1977 | Zaltzman | D03D 29/00 | 28/152 |
| 4,416,040 | A | 11/1983 | Towsley | | |
| 4,508,468 | A * | 4/1985 | Irwin | F16D 1/02 | 403/109.3 |
| 5,281,045 | A * | 1/1994 | Ichikawa | F16B 7/105 | 403/108 |
| 8,316,894 | B2 | 11/2012 | Schaub | | |
| 8,939,674 | B2 * | 1/2015 | Zimmer | A63H 33/062 | 403/14 |
| 2009/0293982 | A1 * | 12/2009 | Skaflestad | D03D 29/00 | 139/34 |
| 2013/0309005 | A1 * | 11/2013 | Barrett | H02B 1/301 | 403/361 |
| 2014/0166150 | A1 * | 6/2014 | Teramoto | D04D 1/04 | 139/29 |
| 2016/0355955 | A1 * | 12/2016 | Hall | D03D 29/00 | |

* cited by examiner

MODULAR ADJUSTABLE HAND LOOM

CROSS REFERENCE TO RELATED APPLICATIONS

This application claims priority to U.S. Provisional Application Ser. No. 62/030,291, filed Jul. 29, 2014, which is incorporated herein by reference in its entirety.

TECHNICAL FIELD

The present technology relates generally to looms for knitting and weaving, and more particularly to adjustable hand looms.

BACKGROUND

Knitting and weaving have long been popular hobbies and a large variety of items can be made on a loom. A typical loom includes pegs that project from the frame around which the yarn is looped in various ways, such as running back and forth between opposite sides of the frame or from peg to peg around a perimeter of the loom. In order to knit material of different sizes and shapes, adjustable frames are desired. However, there are limitations associated with adjustable frame-knitting devices characterized by the prior art.

SUMMARY

One aspect of the disclosed technology relates to a modular hand loom comprising a plurality of interconnected elongate loom sections, each loom section having an upper surface and first and second end portions, at least one first loom section including at the first end portion thereof a tab connector to connect the first loom section with at least one second loom section, the at least one second loom section including at the first end portion thereof a slot connector to connect the second loom section with the at least one first loom section, wherein: the tab connector extends axially from the first end portion of the first loom section and the slot connector comprises an axially extending hollow portion in the second loom section; the tab connector is configured to engage the slot connector in a snap fit arrangement such that a locking member of one of the tab connector and the slot connector is movable between a first position in which the locking member is in locking engagement with a retaining surface of the other of the tab connector and the slot connector, and a second position in which the locking member is unlocked from the retaining surface; and a release member provided on the first loom section or the second loom section is movable so as to displace the locking member to the second position to permit the first loom section to be disconnected from the second loom section.

Another aspect of the disclosed technology relates to an adjustable hand loom comprising a first elongate rail including a plurality of pegs; a second elongate rail extending substantially in parallel with the first elongate rail and thereby defining a width therebetween, the second elongate rail including a plurality of pegs; an elastic member coupling the first rail and the second rail such that the first rail and the second rail are movable relative to one another to increase the width therebetween against a restoring force of the elastic member; and a slider extending between the first and second rails so as to be movable along the first and second rails, the slider including a plurality of pegs to form an adjustable knitting area with the first and second rails, wherein the slider is movable along the first and second rails when the width between the first and second rails is increased.

Other aspects, features, and advantages of this technology will become apparent from the following detailed description when taken in conjunction with the accompanying drawings, which are a part of this disclosure and which illustrate, by way of example, principles of this invention.

BRIEF DESCRIPTION OF THE DRAWINGS

The accompanying drawings facilitate an understanding of the various embodiments of this technology. In such drawings.

DETAILED DESCRIPTION OF ILLUSTRATED EXAMPLES

The following description is provided in relation to several examples (most of which are illustrated) which may share some common characteristics and features. It is to be understood that one or more features of any one example may be combinable with one or more features of the other examples. In addition, any single feature or combination of features in any of the examples may constitute additional examples.

1.0 Modular Hand Loom

Figure 1:
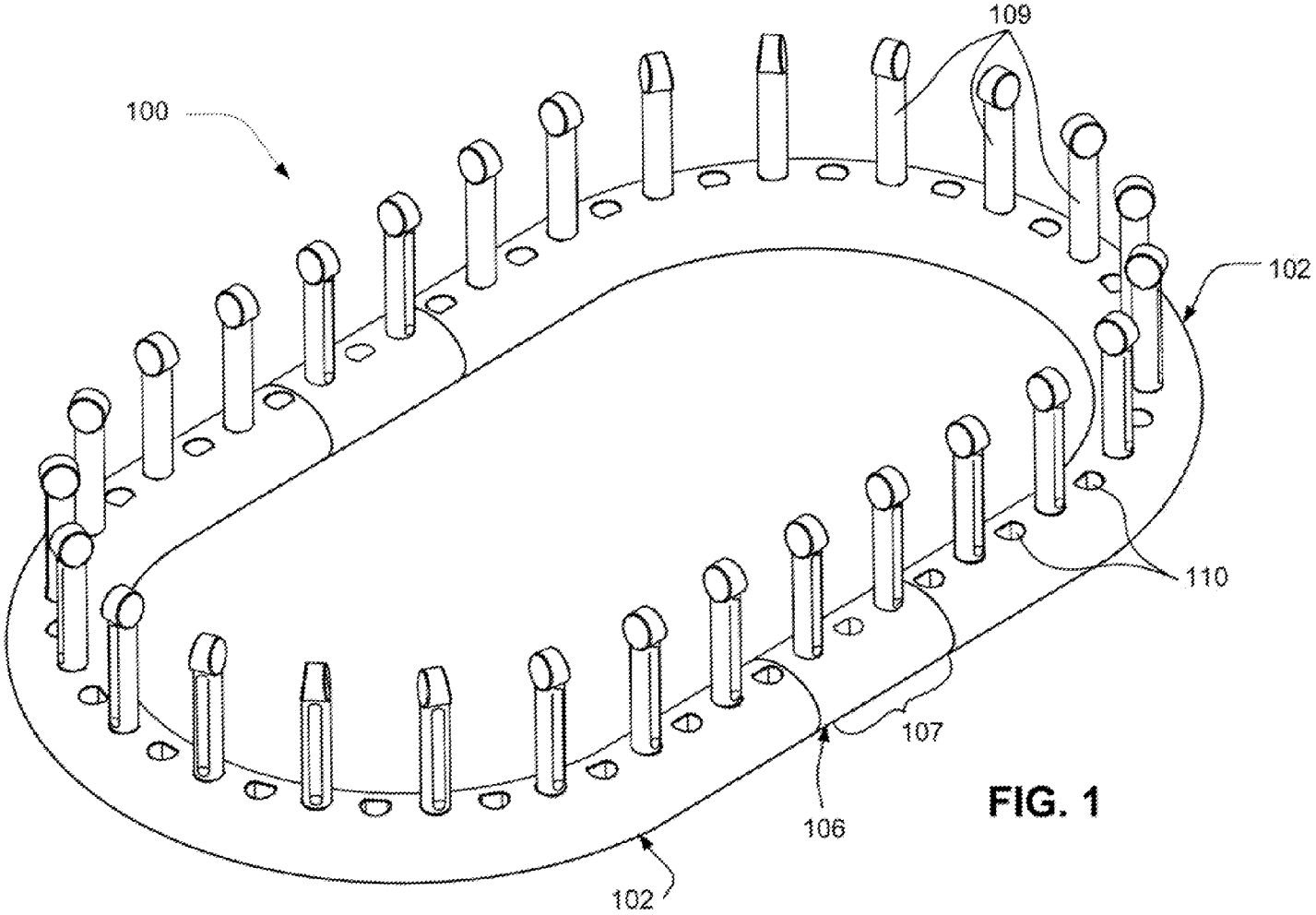
FIG. 1 is a perspective view of a modular hand loom according to an example of the disclosed technology.

Referring to FIG. 1, a module hand loom 100 is shown. The hand loom 100 may include a plurality of elongate sections (or loom sections), including, for example, U-shaped sections 102, linear sections 104, and coupling sections 106 (which are linear in the illustrated examples), as shown in FIGS. 1-4. The modular hand loom 100 may have a closed form as shown in FIG. 1 which facilitates knitting of certain articles (e.g., hats, socks, etc.). The size of the modular hand loom 100 may be adjusted to produce various sized articles via an adjustable linear length 107 of the loom. The plurality of elongate sections may include various interchangeable linear sections 104 having different lengths so as to adjust the size of the loom.

It is noted that the elongate sections may have various other shapes. For example, arcuate or semicircular shapes may be used together with or instead of the U-shaped sections 102. The loom sections may be formed of a molded plastic material. However, other suitable materials may be used.

Figure 2:
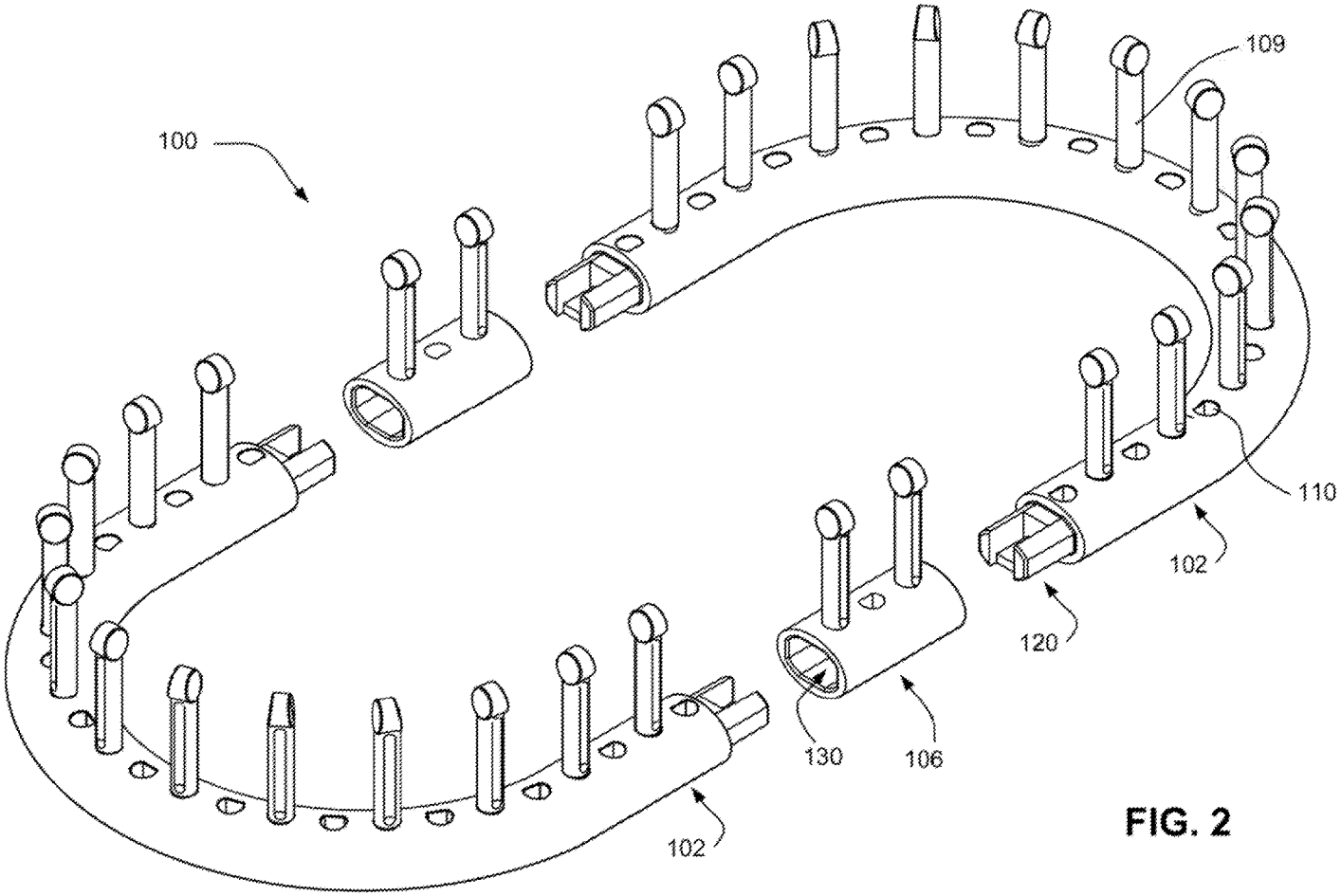
FIG. 2 is an exploded view of the hand loom of FIG. 1.

Each loom section has an upper surface from which pegs 109 extend. The pegs 109 may be removably insertable into holes 110 formed in the loom sections so as to adjust the density of pegs. As shown in FIG. 2, the pegs 109 are inserted into every other hole 110.

Turning to FIG. 2, it can be seen that each loom section includes a connector at an end portion thereof. In the illustrated example, the U-shaped, sections 102 have a male connector (e.g., a tab connector 120) extending axially from an end thereof. The tab connector 120 is configured to connect with a female connector (e.g. a slot connector 130 formed in the coupling section 106. The slot connector 130 forms an axially extending hollow portion. As such, the pegs 109 that extend directly above the hollow portions may be molded with the coupling sections 106 as permanent items so as to prevent the need for a hole to accommodate a removable peg which may interfere with the slot connector 130.

Figure 4:
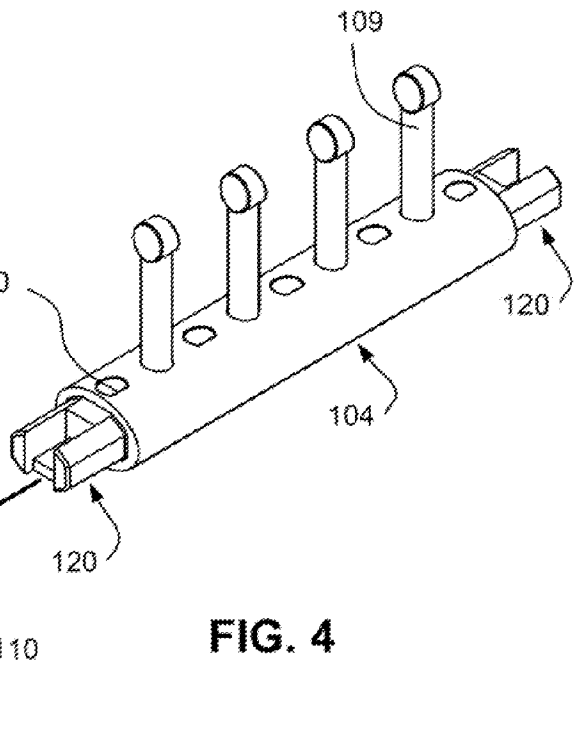
FIGS. 3 and 4 are exploded perspective views of various loom sections according to an example of the disclosed technology.
Figure 3:
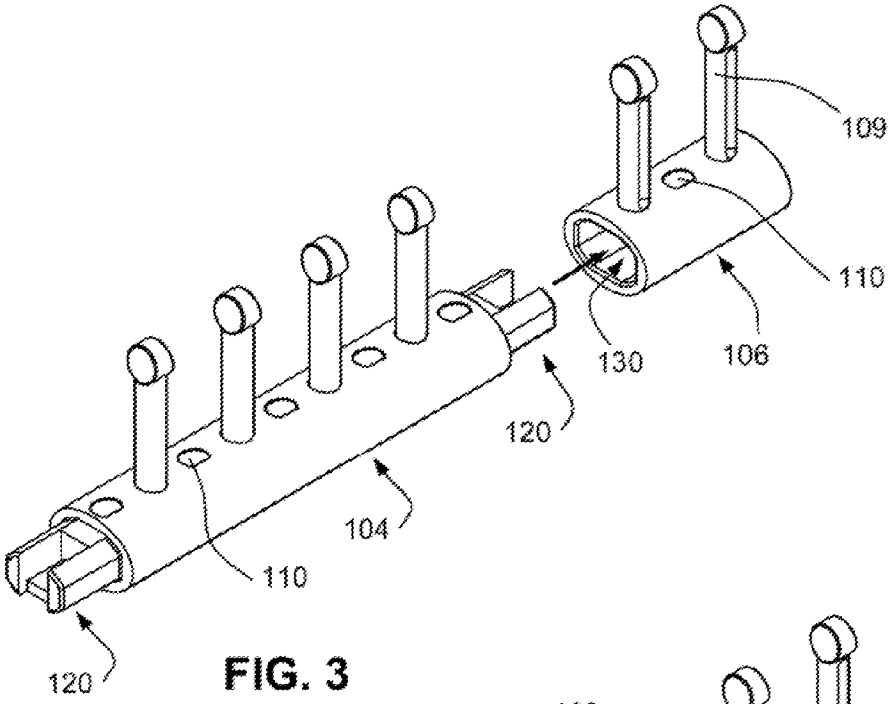

Referring to FIGS. 3 and 4, additional coupling sections 106 may be combined with interchangeable linear sections 104 of various lengths and added to the configuration of FIG. 2 to change the size of the hand loom 100.

Figure 5:
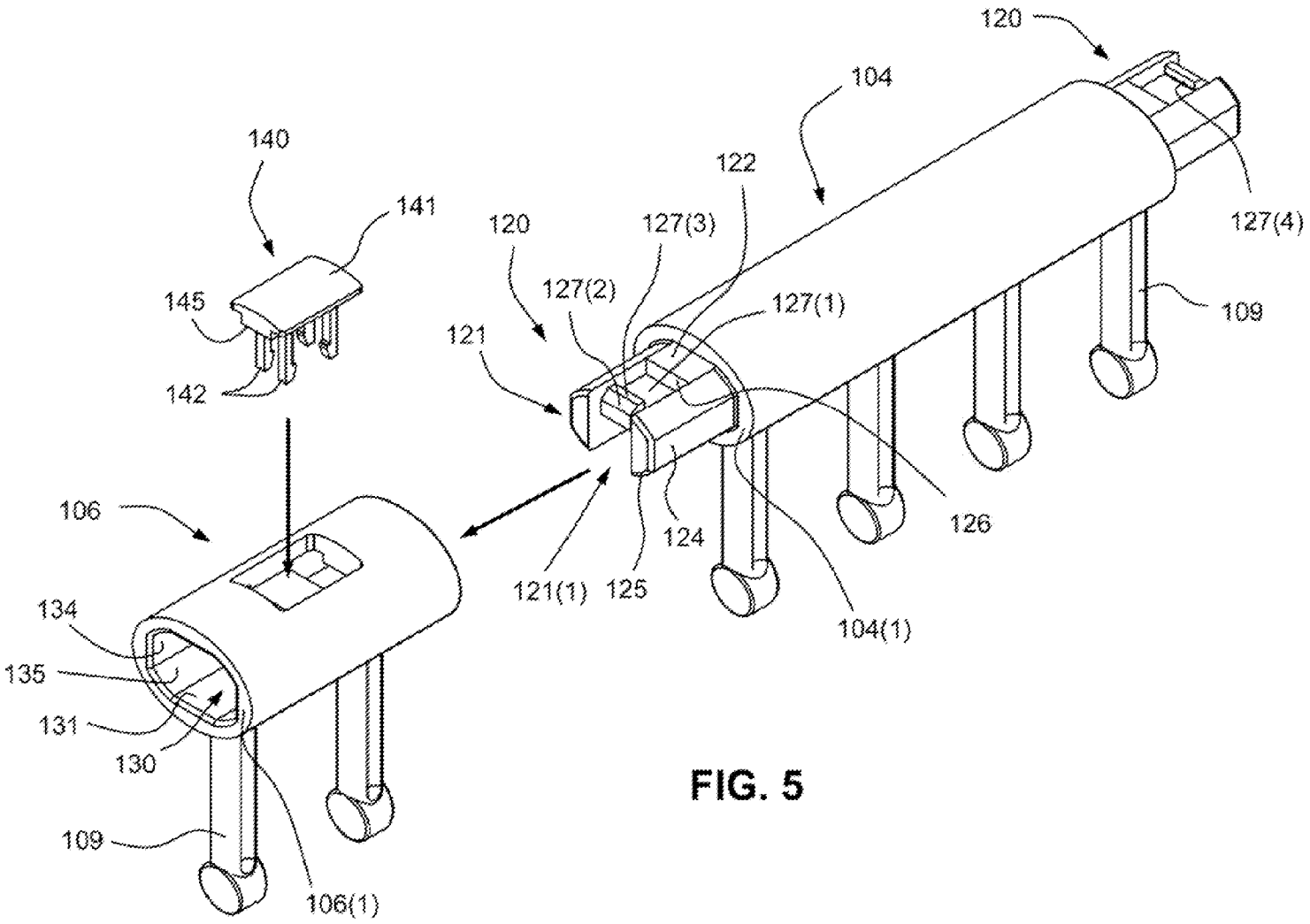
FIG. 5 is an exploded perspective view of various loom sections according to an example of the disclosed technology.
Figure 9:
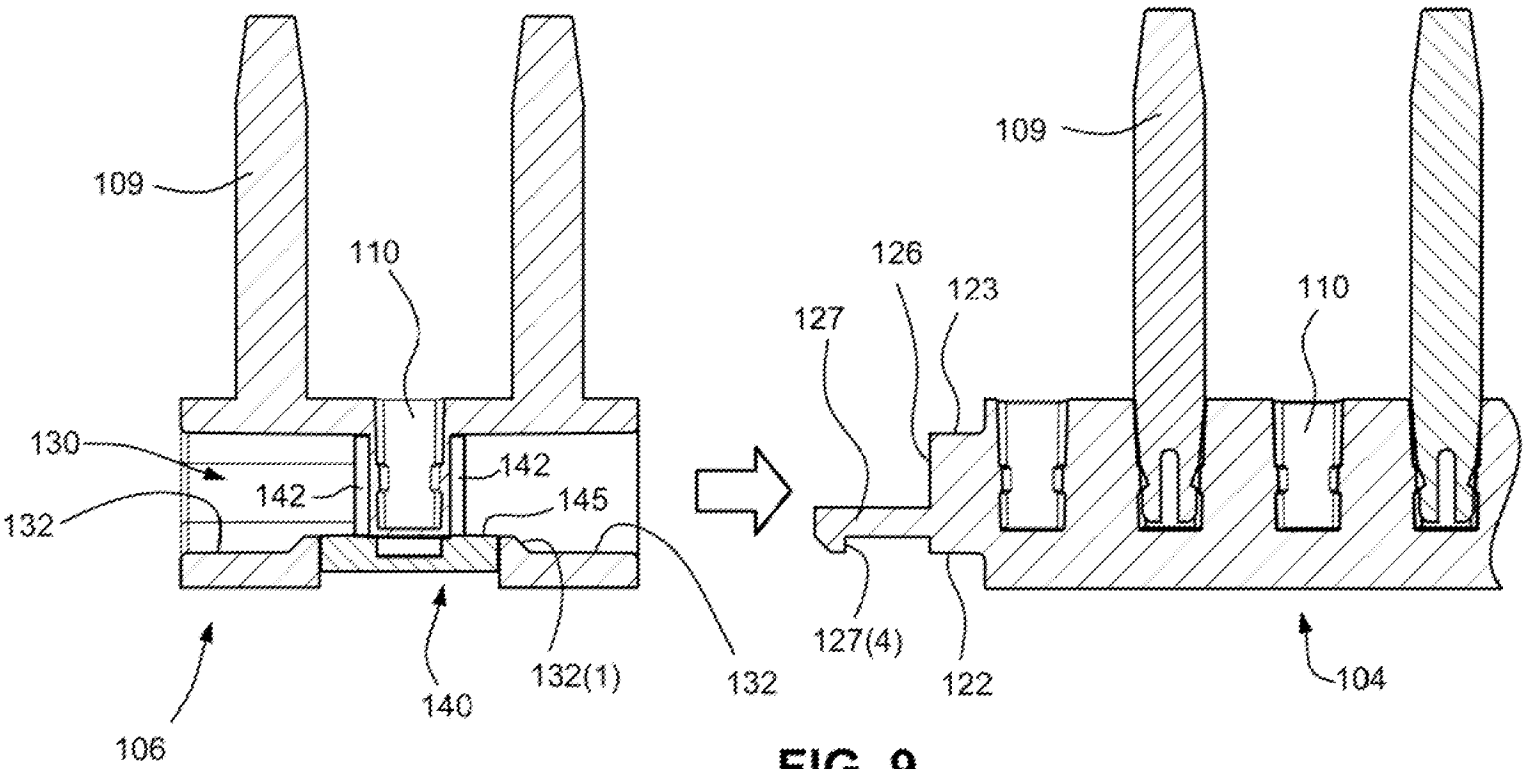
FIG. 9 is a cross-sectional view similar to FIG. 7 showing an action of disconnecting two loom sections.

The tab connector 120 includes a guide 121 and a flexible locking member 127, as shown in FIG. 5. The guide 121 is configured to guide the tab connector 120 into the slot connector 130 as well as provide a stable connection between the coupling section 106 and the linear section 104. The guide 121 may include various surfaces which extend axially from an end face 104(1) of the linear section 104. Particularly, the guide 121 may include a bottom surface 122, opposed side surfaces 124, and a top surface 123 opposite the bottom surface, as best shown in FIGS. 5 and 9. The guide 121 also includes inclined surfaces 125 which extend between the side surfaces 124 and the bottom surface 122 and between the side surfaces 124 and the top surface 123. A cutout 121(1) is formed in the guide 121 such that the bottom surface 122 and the top surface 123 extend only a partial length of the side surfaces 124 and the inclined surfaces 125. As shown in FIG. 5, the cutout forms a mounting wall 126.

Still referring to FIGS. 5 and 9, the flexible locking member 127 extends from the mounting wall 126 in cantilever fashion. The locking member 127 includes a catch 127(1), a ramp 127(2), a protrusion 127(3) and a locking surface 127(4) as will be described in detail below.

Figure 6:
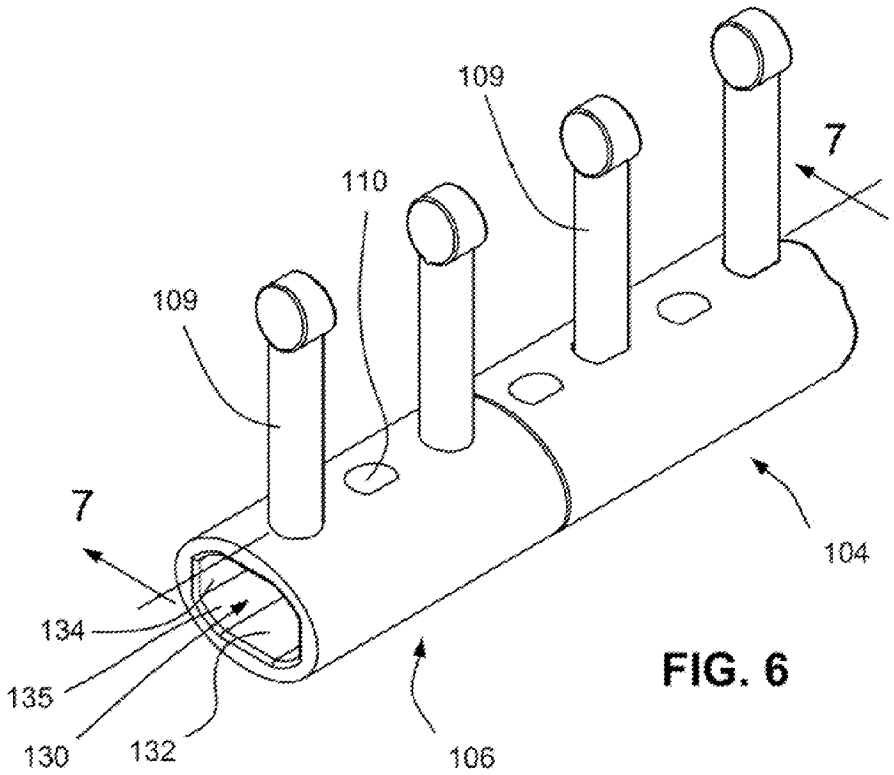
FIG. 6 is a perspective view of a section of a hand loom according to an example of the disclosed technology.

Referring now to FIGS. 5, 6 and 9, the slot connector 130 includes opposed top and bottom surfaces 131, 132 that are configured to respectively engage the top surface 123 and the bottom surface 122 of the guide 121. The slot connector 130 also includes opposed side surfaces 134 that are configured to respectively engage the opposed side surfaces 124 of the tab connector 120. Additionally, inclined surfaces 135 of the slot connector 130 are arranged to engage with the inclined surfaces 125 of the tab connector 120, as best shown in FIGS. 5 and 6. The surfaces of the guide 121 may engage the surfaces of the slot connector 130 with an interference fit to provide a stable, sturdy connection.

Figure 7:
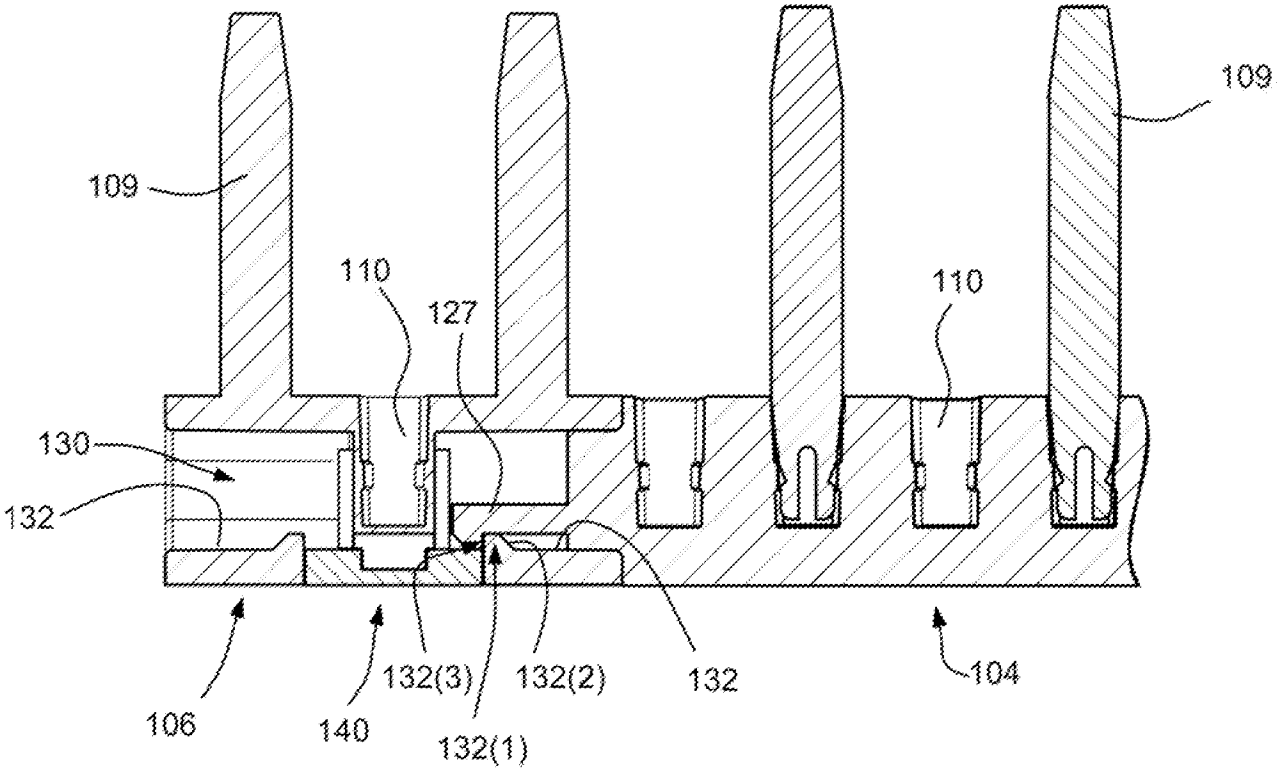
FIG. 7 is a cross-sectional view along the line 7-7 in FIG. 6.
Figure 8:
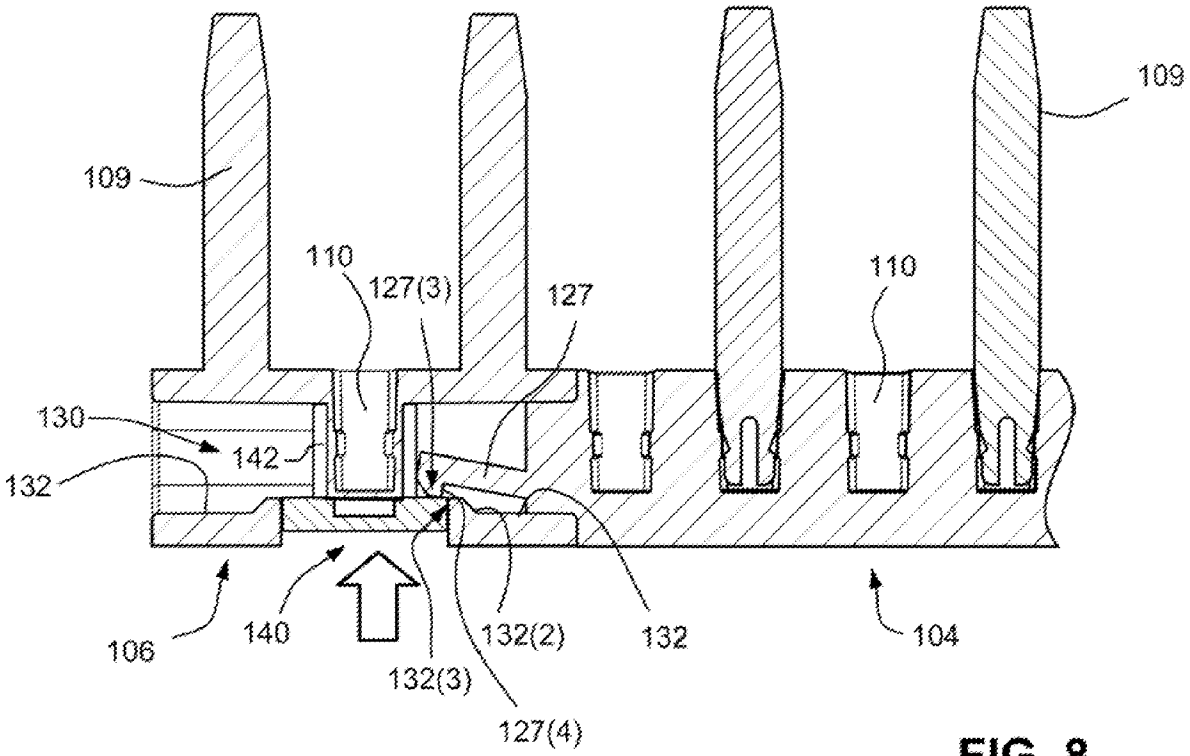
FIG. 8 is a cross-sectional view similar to FIG. 7 showing a release action of the release button according to an example of the disclosed technology.

Turning to FIGS. 5, 7 and 8, the bottom surface 132 of the slot connector 130 includes a fixed locating member 132(1) having an inclined surface 132(2) and a retaining surface 132(3). When the tab connector 120 is inserted into the slot connector 130, the guide 121 serves to properly locate the locking member 127 relative to the locating member 132(1). The ramp 127(2) of the locking member 127 then engages the inclined surface 132(2) causing the locking member 127 to resiliency flex. As the tab connector 120 continues to be inserted into the slot connector 130, the protrusion 127(3) of the locking member 127 clears the locating member 132(1) and snaps into place causing the locating member 132(1) to rest in the catch 127(1) of the locking member such that the locking surface 127(4) of the locking member is arranged to engage the retaining surface 132(3) of the locating member to prevent the locking member 127 from being removed from the slot connector 130.

Figure 10B:
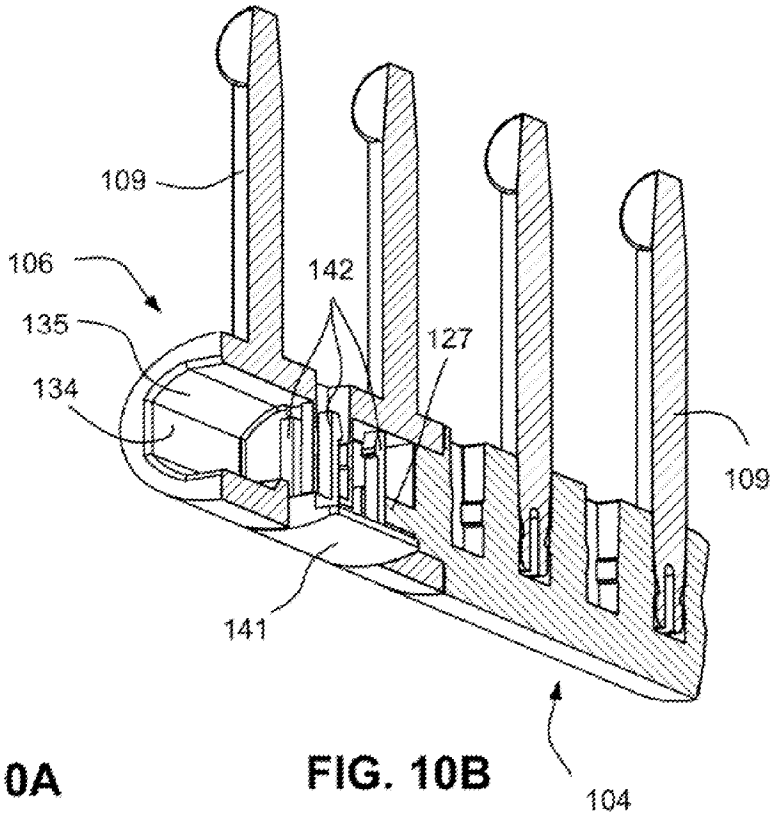
FIG. 10B is an exploded cross-sectional view similar to FIG. 10A showing the release button assembled.
Figure 10A:
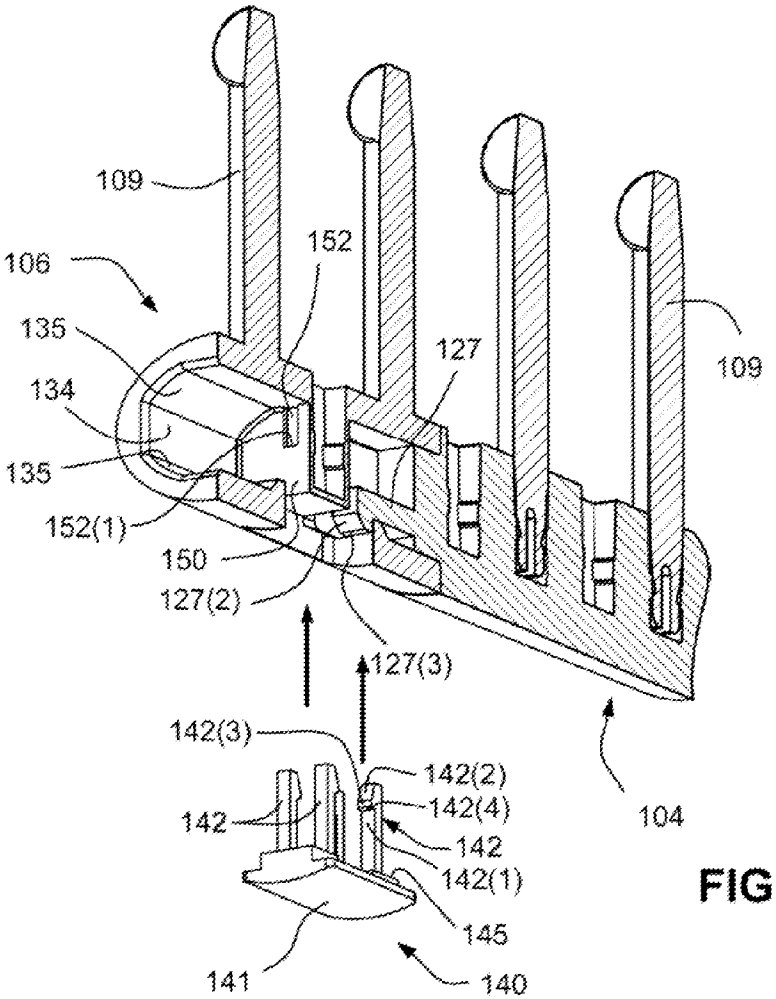
FIG. 10A is an exploded cross-sectional view showing the release button removed according to an example of the disclosed technology.

Turning back to FIG. 5, the coupling section 106 includes a release member (e.g., a release button 140) to facilitate quick and easy disconnection of the tab connector 120 from the slot connector 130. The release button 140 includes an actuating surface 141, locking members 142, and a step 145, as best shown in FIGS. 5 and 10A. The release button 140 is insertable into the coupling section 106 in a snap fit arrangement, as shown in FIGS. 5, 10A and 10B.

Each locking member 142 includes a catch 142(1), a ramp 142(2), a protrusion 142(3), and a locking surface 142(4), as shown in FIG. 10A. The locking members 142 are flexibly mounted to the release button (e.g., to the step 145) in a cantilever fashion. As such, when the release button 140 is inserted into the coupling section 106, each locking member resiliency flexes once the ramp 142(2) engages a locator 150 formed in the coupling section 106, as shown in FIG. 10A. Once the protrusion 142(3) of each locking member 142 reaches a groove 152, the locking member 142 snaps into place such that the locator 150 is received in the catch 142(1) of the locking member. The locking surface 142(4) of the locking member 142 is then arranged to engage the retaining surface 152(1) of the groove 152 to prevent the release button from being removed from the coupling section 106.

Each groove 152 has a length that allows the release button 140 to move relative to the coupling section 106, as can be seen in FIG. 10A. That is, a user may apply a force to the actuating surface 142 of the release button 140 to cause the locking surface 142(4) to travel along the groove 152, as illustrated in FIG. 8. A protrusion may be formed on the surface of the locator 150 at a lower edge thereof and configured to engage the step 145 of the release button 140 to act as a stop to limit movement of the release button when actuated by a user.

FIG. 7 shows the release button 140 in a first position in which the release button allows the tab connector 120 to lockingly engage the slot connector 130. However, as shown in FIG. 8, as the release button 140 is depressed to a second position, the step 145 of the release button 140 presses against protrusion 127(3) of the locking member 127 to cause the locking surface 127(4) to clear the retaining surface 132(3) of the slot connector 130. Once the locking surface 127(4) clears the retaining surface 132(3), the user may apply a force in the axial direction of the loom sections to disconnect the sections from one another, as shown in FIG. 9.

As shown in FIGS. 8, 10A and 10B, the release button 140 can be disposed in the coupling section 106 such that opposite ends of the release button 140 are respectively disposed in operative relationship with slot connectors 130 on opposing end portions of the coupling section 106. That is, a single release button 140 may be used to release the locking members 127 of two tab connectors 120.

It is noted that loom sections shown including the tab connector 120 may instead include the slot connector 130. Likewise, loom sections shown including the slot connector 130 may instead include the tab connector 120. Additionally, in another example, loom sections may include both the tab connector 120 and the slot connector 130 at opposite end portions thereof. Further, in another embodiment, instead of the flexible locking member 127, the tab connector could include a fixed portion and the slot connector could comprise a flexible locking member. Also, the release member may be disposed on any of the other loom sections (e.g., the U-shaped sections 102 and linear sections 104).

Further, the tab connector 120, slot connector 130 and release button 140 may be used in devices other than hand looms, for example, as a general connection mechanism between various items.

2.0 Adjustable Hand Loom

Figure 11:
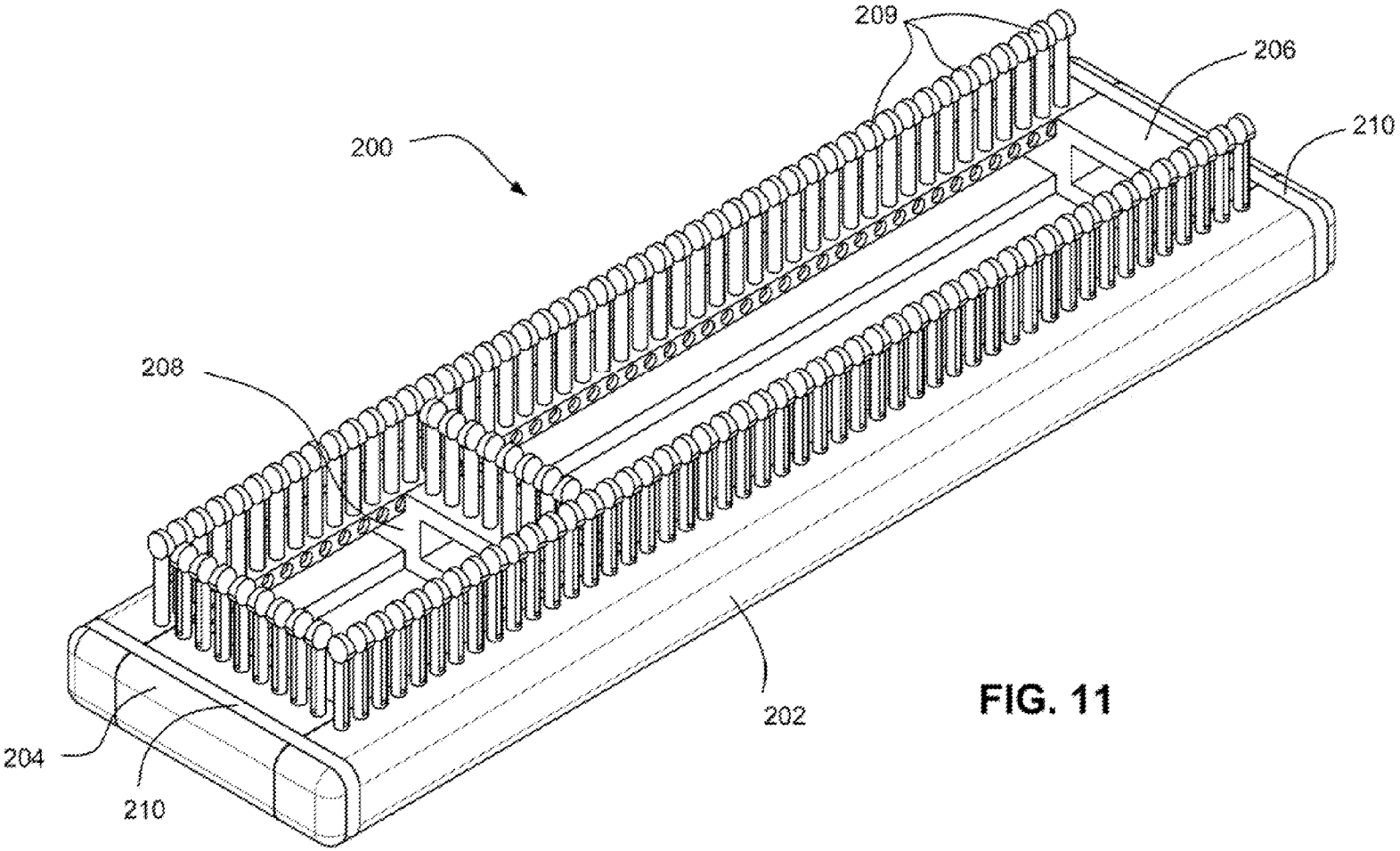
FIG. 11 is a perspective view of an adjustable hand loom according to an example of the disclosed technology.
Figure 15:
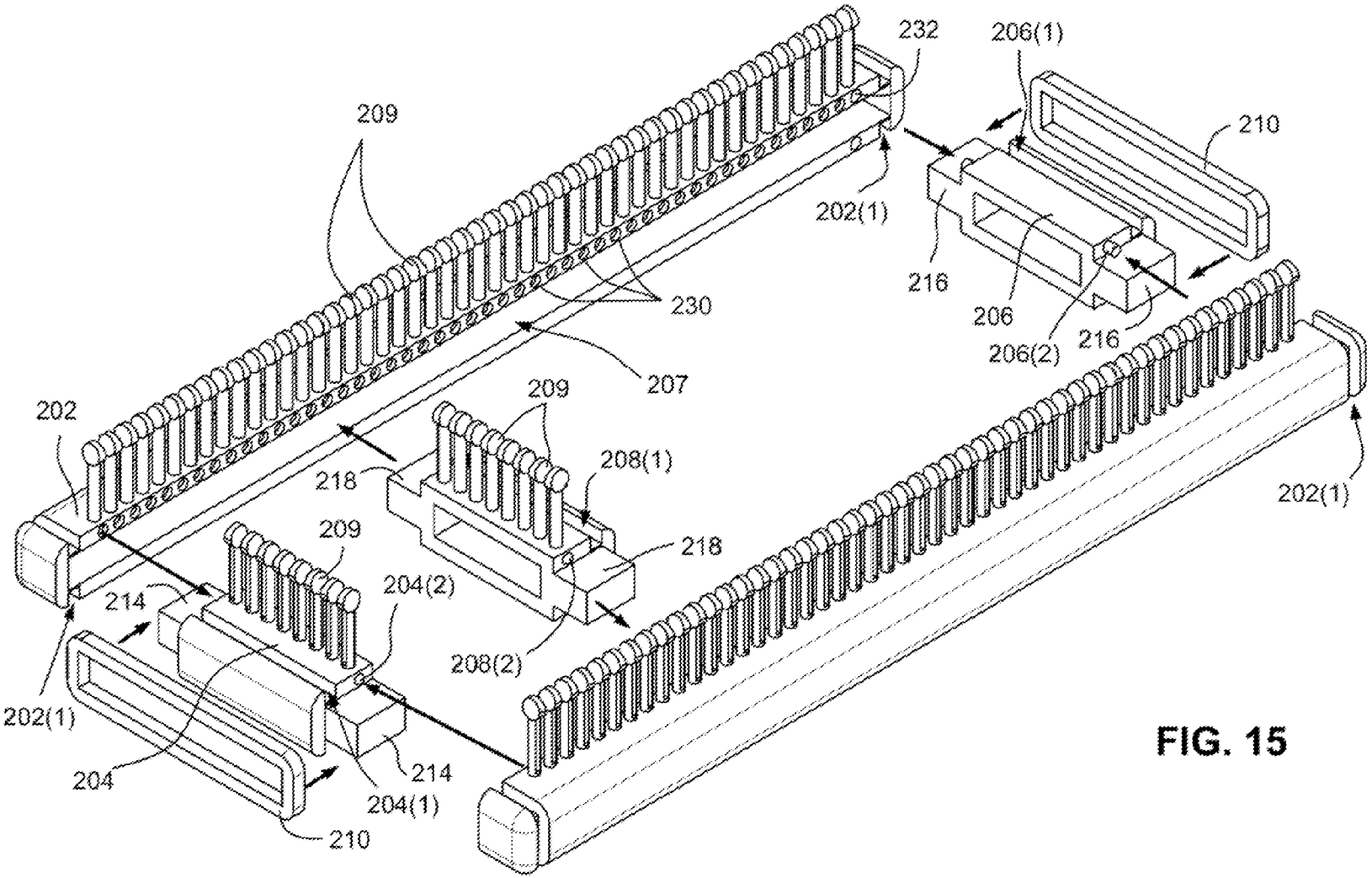
FIG. 15 is an exploded perspective view of the hand loom of FIG. 11.

Referring to FIGS. 11-15, an adjustable hand loom 200 is shown. The hand loom 200 includes two elongate rails 202 extending in parallel. This arrangement may be suitable for knitting certain articles, such as socks for example. Each rail 202 has an upper surface from which pegs 209 extend, as shown in FIG. 11. The pegs 209 may be permanently fixed to the rails (e.g., molded with the rails) or the pegs 209 may be removably inserted into holes on the rails 202. As shown in FIG. 15, each rail 202 includes a channel 207 extending along a length thereof. Additionally, each rail 202 includes a plurality of spaced pockets 230 formed as recesses or holes extending along a length of the rail.

Grooves 202(1) are formed in opposite end portions of the rails 202. The grooves 202(1) are formed in upper, lower and side surfaces of the rails 202, as shown in FIG. 15. The grooves 202(1) are configured to receive an elastic member 210 (e.g., a rubber band). The elastic member may be looped around the rails 202 so as to couple the rails to one another. The elastic member may be formed of any suitable material e.g., a thermoplastic elastomer (TPE) such as formed of a combination of plastic and rubber.

Figure 12:
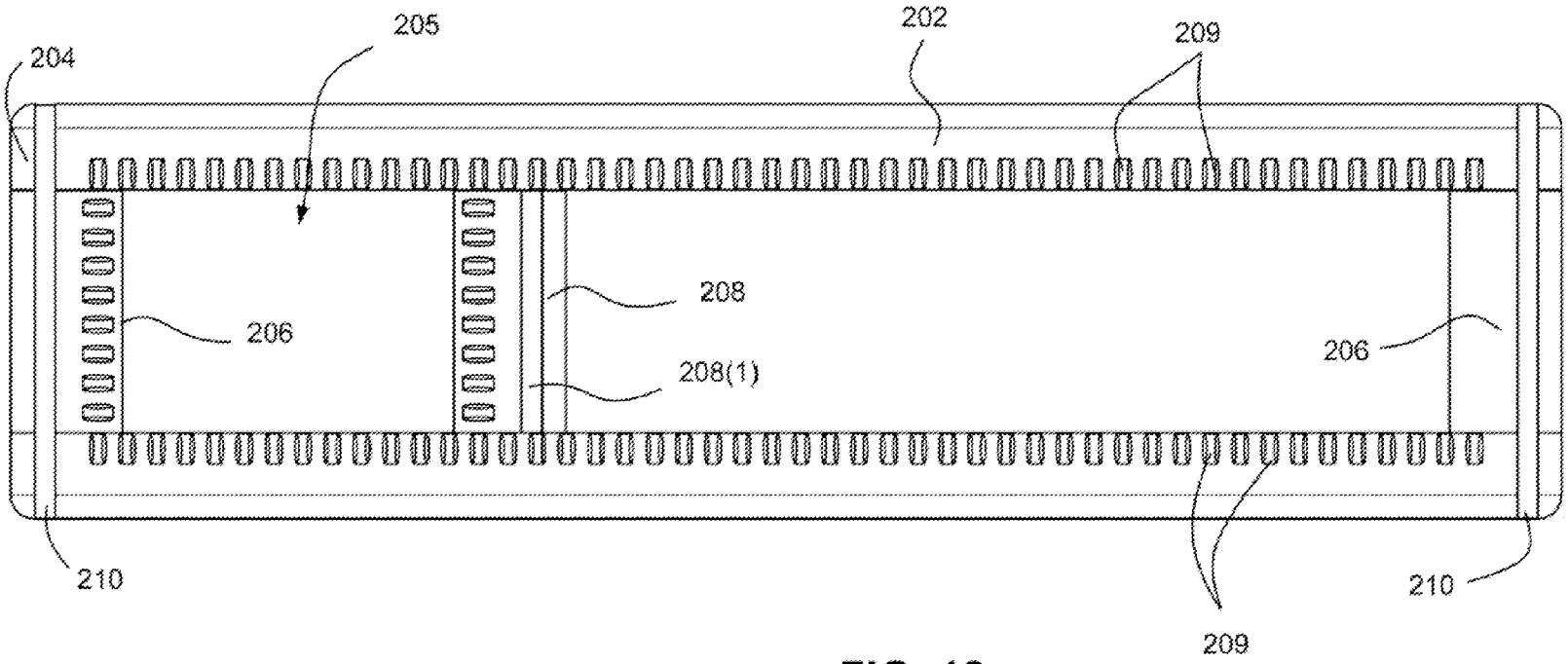
FIG. 12 is a top view of the hand loom of FIG. 11.

A bridge piece 204 may extend between the rails 202, substantially perpendicularly thereto, at one end thereof to define a width of a knitting area 205, as shown in FIG. 12. The bridge piece 204 has an upper surface from which pegs 209 extend. The bridge piece includes a groove 204(1) formed in upper and lower surfaces thereof to accommodate the elastic member 210, as best shown in FIG. 15. The bridge piece 204 also includes two tabs 214 extending from opposite end portions thereof that are configured to be inserted, respectively, into the channel 207 of each rail 202.

By this arrangement, the bridge piece 204 is configured to be slidable relative to the rails 202 along the length of the rails. However, movement of the bridge piece 204 relative to the rails 202 is prevented by locking members (e.g., ball detents 204(2)) that protrude, respectively, from opposite sides of the bridge piece 204, as shown in FIG. 15. The ball detents 204(2) are configured to be received in respective pockets 230 of the rails 202. As such, the elastic member 210 holds the rails against the bridge piece such that the ball detents 204(2) are urged into the pockets 230 of the rails thereby fixing the position of the bridge piece along the rails 202. The position of the elastic member 210 itself in the groove 208(1) also prevents the bridge piece 204 from sliding along the rails 202.

A slider 208 may be configured similarly to the bridge piece 204 including pegs 209, a groove 208(1), locking members (e.g., ball detents 208(2)), and tabs 218, as shown in FIG. 15. In this manner, a single part may be molded for the bridge piece 204 and the slider 208. However, the slider 208 is not disposed at an end portion of the rails 202 and therefore is not positioned to receive an elastic member 210. As such, only the ball detents 208(2) prevent the slider 208 from sliding along the rails 202.

Figure 13:
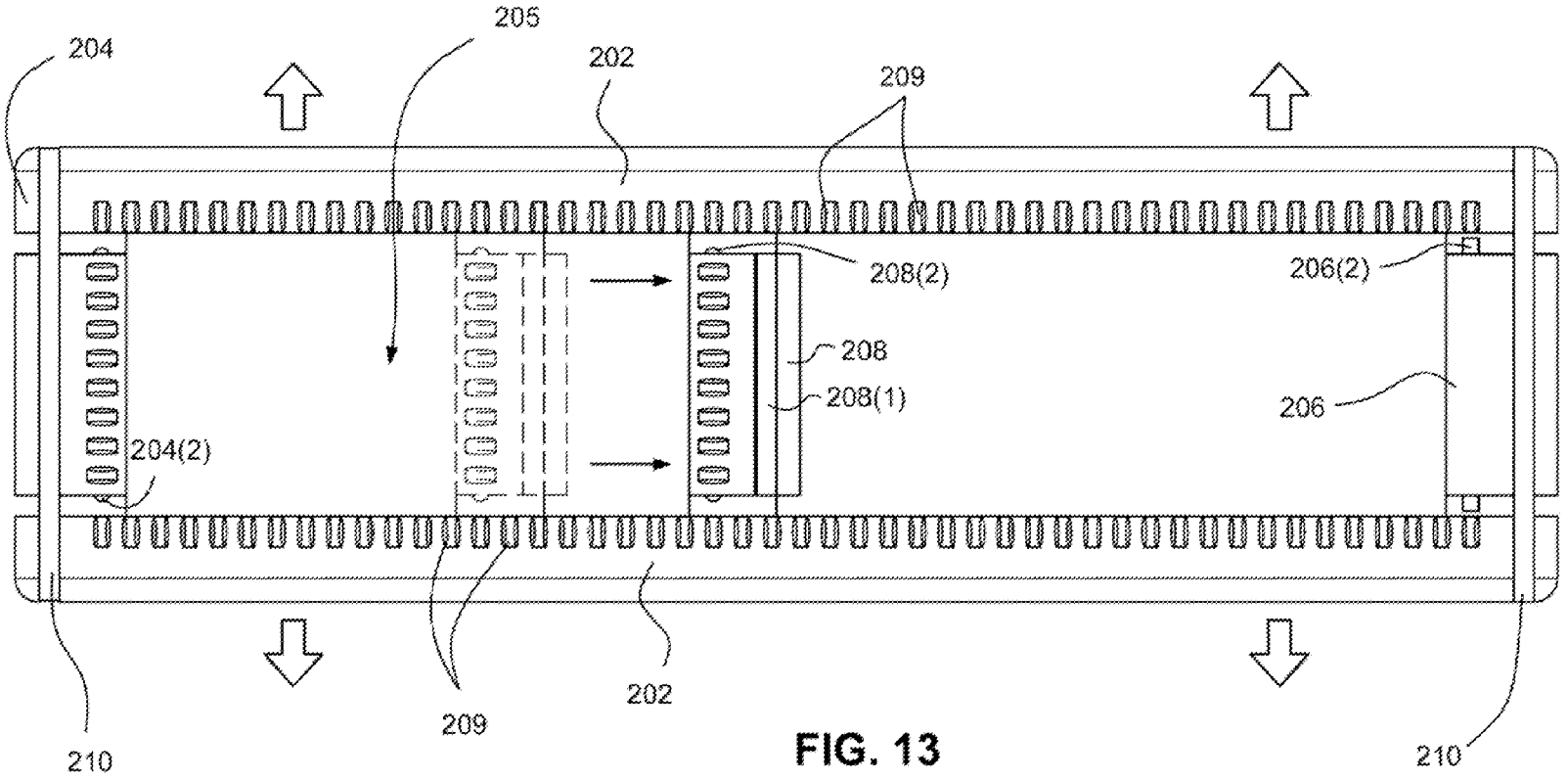
FIG. 13 is a top view similar to FIG. 12 showing an action of adjusting the knitting area.
Figure 14:
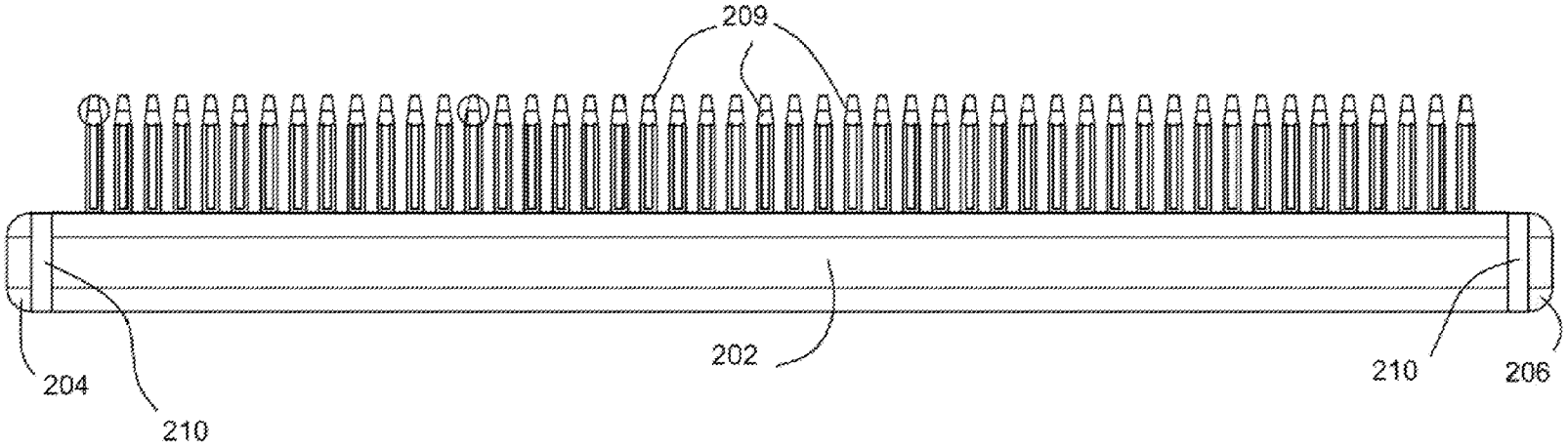
FIG. 14 is a side view of the hand loom of FIG. 11.

Thus, a user may pull the rails 202 in opposite directions against a restoring force of the elastic members 210 to free the ball detents 208(2) from the pockets 230 to enable the position of the slider 208 along the rails 202 to be adjusted, as shown in FIG. 13. By movement of the slider 208 along the rails 202, the size of a knitting area 205 is adjusted. Once the user releases the force against the rails 202, the elastic members 210 pull the rails 202 back into engagement with the slider 208.

An end piece 206 may extend between the rails 202 at an end opposite the bridge piece 204, as shown in FIGS. 11 and 15. The end piece may be configured similarly to the bridge piece 204, including a groove 206(1) and tabs 216, except that it is not necessary that the end piece 206 include pegs since the knitting area 205 is defined, by the rails 202 and the slider 208. Additionally, referring to FIG. 15, the end piece 206 may include protrusions 206(2) having greater extending lengths than the ball detents 204(2), 208(2) which may be configured to be received in holes 232 of the rails 202 that are deeper than the pockets 230 so as to facilitate the end piece 206 being stably positioned between the rails 202.

It is also noted that the elastic members 210 may be used to couple rails that are not used with a sliding member. In this arrangement, there would be no need to separate the rails against a restoring force of the elastic members. Instead, the elastic members would simply hold the rails together, for example, against a spacer extending therebetween.

While the examples discussed above have been described in connection with what are presently considered to be practical and preferred features, it is to be understood that appended claims are intended to cover modifications and equivalent arrangements included within the spirit and scope of these examples.

What is claimed is:

1. A modular hand loom, comprising:

a plurality of interconnected elongate loom sections, each loom section having an upper surface and first and second end portions, at least one first loom section including at the first end portion thereof a tab connector to connect the first loom section with at least one second loom section, the at least one second loom section including at the first end portion thereof a slot connector to connect the second loom section with the at least one first loom section, wherein:

the tab connector extends axially from the first end portion of the first loom section and the slot connector comprises an axially extending hollow portion in the second loom section, the tab connector is configured to engage the slot connector in a snap fit arrangement such that a locking member of one of the tab connector and the slot connector is movable between a first position in which the locking member is in locking engagement with a retaining surface of the other of the tab connector and the slot connector, and a second position in which the locking member is unlocked from the retaining surface, and a release member provided on the first loom section or the second loom section is movable so as to displace the locking member to the second position to permit the first loom section to be disconnected from the second loom section.

2. The modular hand loom of claim 1, wherein the release member is provided on the second loom section, and the release member is movable relative to the slot connector.

3. The modular hand loom of claim 2, wherein the release member is retained in a groove formed in the second loom section.

4. The modular hand loom of claim 3, wherein the release member engages the groove in a snap fit.

5. The modular hand loom of claim 4, wherein the release member includes a plurality of locking members and the second loom section includes a plurality of grooves to respectively receive the locking members.

6. The modular hand loom of claim 2, wherein the release member includes a surface configured to engage the tab connector to move the tab connector to the second position of the tab connector.

7. The modular hand loom of claim 6, wherein surface of the release member is a step protruding upwardly from the release member.

8. The modular hand loom of claim 1, wherein the tab connector includes the flexible locking member, the locking member is configured to engage a locating member of the slot connector which causes the locking member to resiliently flex into the snap fit arrangement.

9. The modular hand loom of claim 8, wherein the locking member has a ramp that is configured to slidingly engage an inclined surface of the locating member.

10. The modular hand loom of claim 8, wherein the locking member has a locking surface and the slot connector includes the retaining surface, the locking surface being configured to engage the retaining surface to prevent the tab connector from being disconnected from the slot connector when the locking member is in the first position.

11. The modular hand loom of claim 8, wherein the release member includes a surface configured to engage the locking member to move the locking member to the second position.

* * * * *